US007856667B2

(12) United States Patent
Grilliot et al.

(10) Patent No.: US 7,856,667 B2
(45) Date of Patent: Dec. 28, 2010

(54) LIQUID-TIGHT, PULL-OVER, PROTECTIVE GARMENT FOR UPPER TORSO

(75) Inventors: William L. Grilliot, Dayton, OH (US); Mary I. Grilliot, Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 291 days.

(21) Appl. No.: 10/901,257

(22) Filed: Jul. 28, 2004

(65) Prior Publication Data

US 2006/0021107 A1 Feb. 2, 2006

(51) Int. Cl.
*A41D 13/00* (2006.01)

(52) U.S. Cl. ..... 2/69

(58) Field of Classification Search ..... 2/456, 2/458, 69, 102, 108, 5, 6.1, 69.5, 82, 88, 2/2.11, 2.15, 410, 205
See application file for complete search history.

(56) References Cited

U.S. PATENT DOCUMENTS

| | | | | | |
|---|---|---|---|---|---|
| 1,466,726 | A * | 9/1923 | Meeks | 2/458 |
| 3,323,136 | A * | 6/1967 | Beck | 2/87 |
| 4,064,562 | A * | 12/1977 | Kenny | 2/84 |
| 4,202,053 | A * | 5/1980 | Bell | 2/84 |
| 4,272,851 | A * | 6/1981 | Goldstein | 2/79 |
| 4,274,158 | A * | 6/1981 | Pogorski et al. | 2/2.16 |
| 4,577,348 | A * | 3/1986 | Hoffmann | 2/84 |
| D294,535 | S * | 3/1988 | Stricklin | D2/831 |
| 4,864,654 | A * | 9/1989 | Schriver et al. | 2/84 |
| 5,383,918 | A * | 1/1995 | Panetta | 607/104 |
| 5,548,846 | A * | 8/1996 | Bianchetti | 2/209.12 |
| 6,032,285 | A * | 3/2000 | Densen | 2/456 |
| 6,374,823 | B1 * | 4/2002 | Hajianpour | 128/201.22 |
| 6,397,395 | B1 * | 6/2002 | DeHart | 2/206 |
| 6,792,625 | B2 * | 9/2004 | Hexels | 2/457 |
| 6,895,960 | B2 * | 5/2005 | Fabin | 128/201.23 |
| 7,458,104 | B1 * | 12/2008 | Garcia | 2/69.5 |

* cited by examiner

*Primary Examiner*—Tejash Patel
(74) *Attorney, Agent, or Firm*—Wood, Phillips, Katz, Clark & Mortimer

(57) ABSTRACT

A liquid-tight, pull-over, protective garment, which is adapted to be worn by a wearer, under a helmet worn by the wearer, under gloves worn by the wearer, and over another garment or other garments worn by the wearer, is adapted to cover the head, upper torso, arms, and hands of the wearer even if the protective garment is worn without a helmet and without gloves. In one contemplated embodiment, substantially all of the protective garment, and particularly a portion of the protective garment that covers the eyes of the wearer when the protective garment is worn, is transparent. In an alternative embodiment, a portion of the protective garment, at least where the protective garment when worn covers the eyes of the wearer, comprises a transparent window. A protective ensemble comprises the protective garment, a helmet, which is adapted to be worn over a head-covering portion of the protective garment, and a pair of gloves, each of which is adapted to be worn over a hand-covering portion of the protective garment.

10 Claims, 2 Drawing Sheets

LIQUID-TIGHT, PULL-OVER, PROTECTIVE GARMENT FOR UPPER TORSO

TECHNICAL FIELD OF THE INVENTION

This invention pertains to a protective garment for a firefighter, a chemical worker, or an emergency rescue worker, who faces a risk of being splashed, sprayed, or contacted by a hazardous or potentially hazardous substance, in a liquid or particulate form.

BACKGROUND OF THE INVENTION

Occasionally, a firefighter, or a chemical worker, or an emergency rescue worker is called to respond to an incident, such as a vehicle wreck or a chemical spill, without an adequate opportunity to don protective garments designed to protect him or her against being splashed, sprayed, or contacted by blood of a victim, by a hazardous chemical, or by another hazardous or potentially hazardous substance, in a liquid or particulate form.

In U.S. Pat. No. 6,134,717, a protective garment is disclosed, which employs leg portions including socks and which employs cuffs attached to the leg portions, whereby to prevent liquids from entering boots. Although the disclosed garment protects the lower torso, legs, and feet of the wearer, the disclosed garment does not protect the upper torso, arms, or hands of the wearer.

SUMMARY OF THE INVENTION

This invention provides a liquid-tight, pull-over, protective garment, which is adapted to be worn by a wearer, over another garment or other garments worn by the wearer. Broadly, the protective garment is adapted to cover the head, upper torso, and arms of the wearer even if the protective garment is worn without a helmet. Preferably, the protective garment is adapted to cover the head, upper torso, arms, and hands of the wearer even if the protective garment is worn without a helmet and without gloves.

In one contemplated embodiment, at least a portion of the protective garment, at least where the protective garment when worn covers the eyes of the wearer, is transparent. In an alternative embodiment, the protective garment has an open window having a margin, which coacts with a face mask of a self-contained breathing apparatus (SCBA) or of an air-breathing apparatus, so as to provide a liquid-tight seal between the margin of the open window and the face mask.

In one contemplated embodiment, substantially all of the protective garment, particularly a portion thereof that covers the eyes of the wearer when the protective garment is worn, is transparent. In an alternative embodiment, at least a portion of the protective garment, at least where the protective garment when worn covers the eyes of the wearer, comprises a transparent window.

This invention also provides a protective ensemble comprising a protective garment, as described above, a helmet, and a pair of gloves, wherein the helmet is adapted to be worn outside a head-covering portion of the protective garment and wherein each glove of the pair is adapted to be worn over a hand-covering portion of the protective garment.

This invention also provides a protective ensemble comprising a protective garment, as described above, a helmet, and, preferably, a pair of gloves, wherein the helmet is adapted to be worn either inside or outside a head-covering portion of the protective garment and wherein each glove of the pair, if provided, is adapted to be worn over a hand-covering portion of the protective garment.

DETAILED DESCRIPTION OF THIS INVENTION

Figure 1:
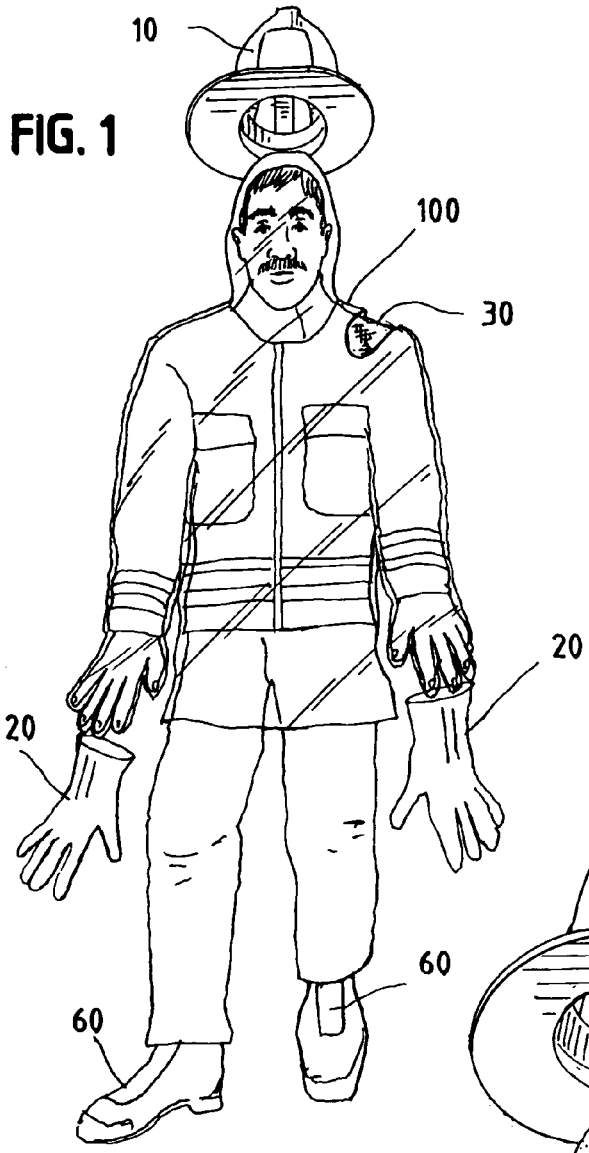
FIG. 1 is a front, perspective view of a firefighter wearing, along with a helmet, gloves, boots, and other protective garments, a protective garment conforming to a first embodiment of this invention, as worn under a helmet and under gloves.

As illustrated in FIG. 1, a firefighter is wearing a protective ensemble comprising a helmet 10, a pair of gloves 20, a protective coat 30, a pair of protective pants 50, and a pair of boots 60, along with a protective garment 100 conforming to a first embodiment of this invention. The protective garment 100 is worn by the firefighter, under the helmet 10, under the gloves 20, and over the protective coat 30. The protective garment 100 is adapted to cover the head, upper torso, arms, and hands of the firefighter even if the protective garment 100 is worn without the helmet 10 and without the gloves 20.

In the embodiment illustrated in FIG. 1, the protective garment 100 is made from a flexible, liquid-tight, transparent, polymeric material, such as Mylar™ polyester film, so that substantially all of the protective garment 100 is transparent. If the protective garment 100 is not seamless, any seams of the protective garment 100 are sealed so as to be liquid-tight.

Figure 2:
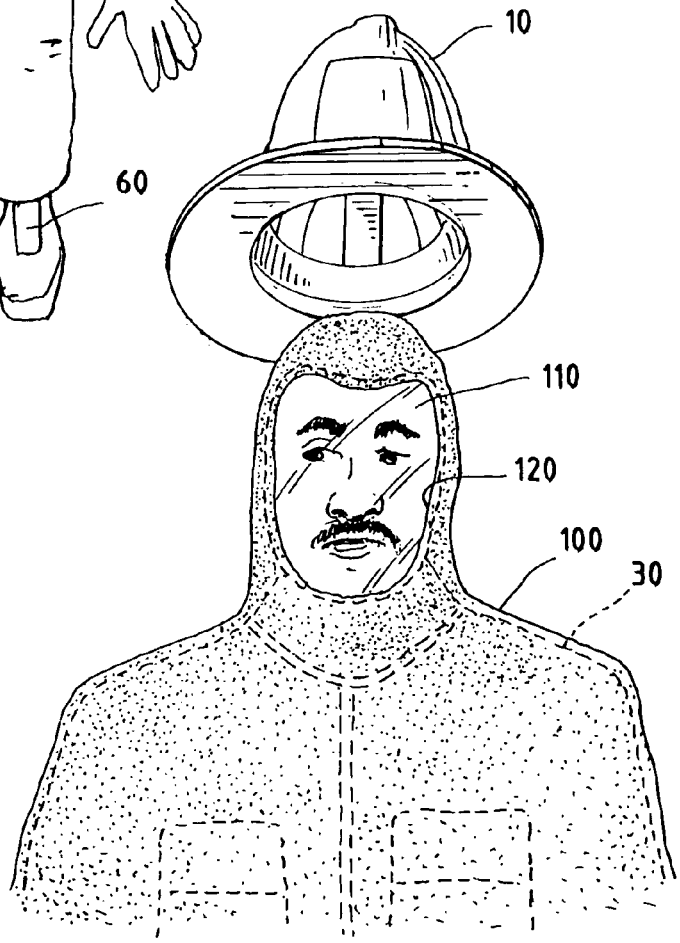
FIG. 2 is a similar, fragmentary views showing a second embodiment of this invention, as worn under a helmet and under gloves.

In the embodiment illustrated in FIG. 2, the protective garment 100 is made from a thin, flexible, liquid-tight, opaque or translucent, polymeric material, such as Mylar™ polyester film or from a woven or nonwoven fabric, which is treated so as to be liquid-tight, except that a head-covering portion of the protective garment 100, where the protective garment 100 when worn covers the eyes of the firefighter comprises a transparent window 110, which is made from a thin, flexible, liquid-tight, transparent, polymeric material, such as Mylar™ polyester film, or from a sheet of a more rigid, liquid-tight, transparent, polymeric material, such as polycarbonate. The seam between the margin 120 of the transparent window 110 and the adjacent material of the head-covering portion of the protective garment 100 and, if the protective garment 100 has any other seams, its other seams are sealed so as to be liquid-tight.

So as to permit the firefighter to breathe for a prolonged period, the firefighter may be equipped with a self-contained breathing apparatus (SCBA) or with an air-filtering apparatus, in a manner disclosed in U.S. patent application Publication No. U.S. 2003/0221247 A1, the disclosure of which is incorporated by reference herein.

Figure 3:
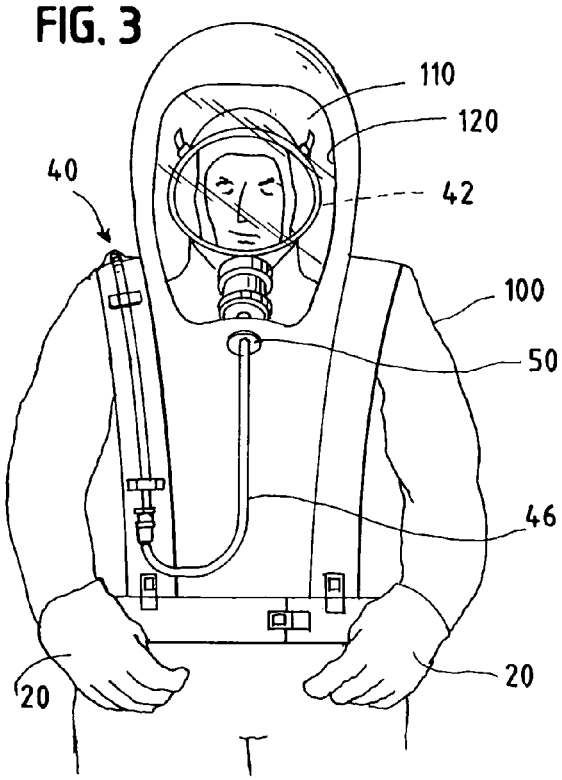
FIGS. 3 and 4 are similar, fragmentary views showing combinations of the second embodiment with other apparatus.
Figure 4:
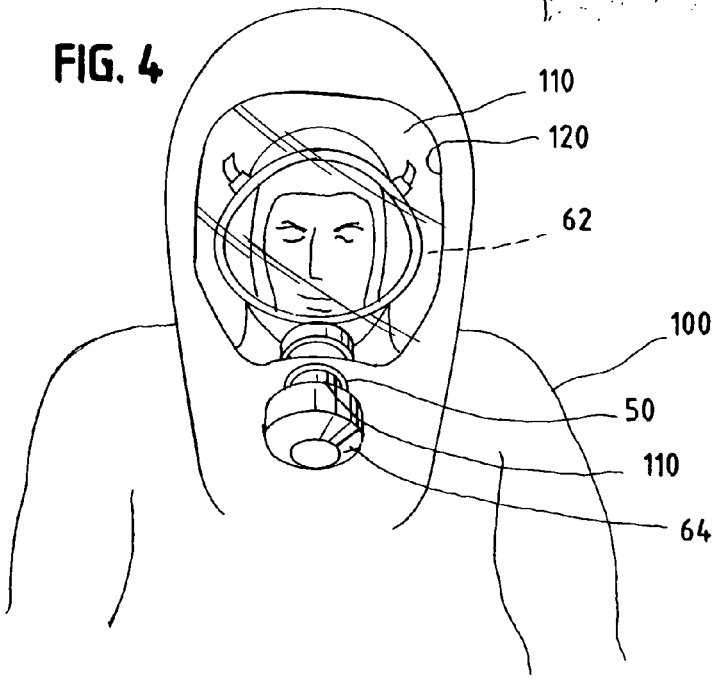

Accordingly, as shown in FIG. 3, the self-contained breathing apparatus 40 may include elements including a face mask 42 inside the protective garment 100, elements including an air bottle (not shown) outside the protective garment 100, and a tube 46 connecting the inside and outside elements and fitting tightly through an elastomeric grommet 50, which adheres to an outside surface of the protective garment 100. Alternatively, as shown in FIG. 4, the air-filtering apparatus 60 may include elements including a face mask 62 inside the protective garment 100, elements including an air filter 64 outside the protective garment 100, and a short, rigid tube 66 connecting the inside and outside elements and fitting tightly through the elastomeric grommet 50, which adheres to an outside surface of the protective garment 100.

Figure 5:
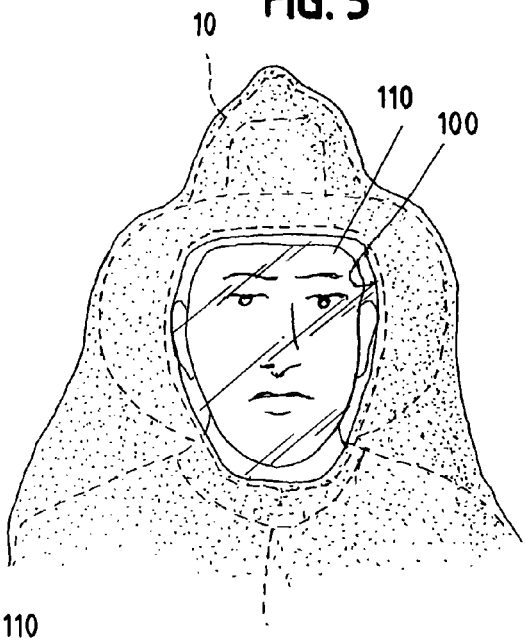
FIG. 5 is a similar, fragmentary view showing the second embodiment, as worn over a helmet.

The embodiment shown in FIG. 5 is similar to the embodiment shown in FIG. 2, except that, in the embodiment shown in FIG. 5, the helmet 10 is worn inside the protective garment 100, the head-covering portion of which is adapted to fit over the helmet 10.

In the protective ensemble, the helmet 10 is worn over the head-covering portion of the protective garment 100 and each of the gloves 20 is worn over a hand-covering portion of the protective garment 100. Advantageously, the protective garment 100 protects the head, upper torso, arms, and hands of the firefighter, the protective coat 30, and the protective hood 40 against being splashed, sprayed, or contacted by blood of a victim, by a hazardous chemical, or by another hazardous or potentially hazardous substance, in a liquid or particulate form, even if the helmet 10 and the gloves 20 are not worn.

Because of its construction, the protective garment 100 can be compactly stored, possibly in a pocket of the protective coat 30. Moreover, it may be cost-effective to discard the protective garment 100 after a single use, rather than to endeavor to clean the protective garment 100 for re-use.

The invention claimed is:

1. A protective garment comprising an integrated, liquid-tight body having a head covering portion, a pair of arm and hand covering portions, and an upper torso covering portion having an open bottom, the body constructed as a pull-over garment wherein the open bottom receives the head, arms, and upper torso of a user wearer when the garment is donned, the head covering portion being transparent at least in an area covering the eyes of a wearer.

2. The protective garment of claim 1 wherein a majority of the body is transparent.

3. The protective garment of claim 1 wherein the head covering portion is sized to cover at least one of a helmet and a face mask.

4. A protective garment comprising an integrated, liquid-tight body having a head covering portion, a pair of arm and hand covering portions, and an upper torso covering portion having an open bottom, the body constructed as a pull-over garment wherein the open bottom receives the head, arms, and upper torso of a user wearer when the garment is donned, the head covering portion comprising a transparent window at least in an area covering the eyes of a wearer.

5. The protective garment of claim 4 wherein the head covering portion is sized to cover at least one of a helmet and a face mask.

6. A protective garment comprising an integrated, liquid-tight body having a head covering portion, a pair of arm and hand covering portions, and an upper torso covering portion having an open bottom, the body constructed as a pull-over garment wherein the open bottom receives the head, arms, and upper torso of a user wearer when the garment is donned, the head covering portion comprising an open window having margins adapted to coact with a face mask of a self-contained breathing apparatus or of an air-breathing apparatus to provide a liquid-tight seal between the margin of the open window and the face mask.

7. The protective garment of claim 1, 4, or 6, wherein the body comprises a polymeric material.

8. The protective garment of claim 1, 4, or 6 wherein the body comprises a Mylar™ polyester film.

9. A protective garment comprising an inseparable, liquid-tight body having a head covering portion, a pair of tubular arm covering portions, and an upper torso covering portion having an open bottom, the body constructed as a pull-over garment wherein the open bottom receives the head, arms, and upper torso of a user wearer when the garment is donned, the head covering portion being transparent at least in an area covering the eyes of a wearer, wherein the integrated, liquid-tight body further comprises a pair of hand covering portions, with each of the tubular arm covering portions extending from the upper torso covering portion to a corresponding one of the hand covering portions.

10. A protective garment comprising an integrated, liquid-tight body having a head covering portion, a pair of tubular arm covering portions, and an upper torso covering portion having an open bottom, the body constructed as a pull-over garment wherein the open bottom receives the head, arms, and upper torso of a user wearer when the garment is donned, the head covering portion being transparent at least in an area covering the eyes of a wearer, wherein the integrated, liquid-tight body further comprises a pair of hand covering portions, with each of the tubular arm covering portions extending from the upper torso covering portion to a corresponding one of the hand covering portions.

* * * * *